US007011479B2

(12) United States Patent
Sain

(10) Patent No.: US 7,011,479 B2
(45) Date of Patent: Mar. 14, 2006

(54) SHIPPING PLATFORM

(75) Inventor: Bernard S. Sain, Jacksonville, FL (US)

(73) Assignee: ITL Technologies, Inc., Jacksonville, FL (US)

( * ) Notice: Subject to any disclaimer, the term of this patent is extended or adjusted under 35 U.S.C. 154(b) by 122 days.

(21) Appl. No.: 10/622,536

(22) Filed: Jul. 21, 2003

(65) Prior Publication Data

US 2005/0019127 A1 Jan. 27, 2005

(51) Int. Cl.
*B60P 7/06* (2006.01)
*B60P 3/073* (2006.01)

(52) U.S. Cl. ..... 410/46; 410/77

(58) Field of Classification Search ..... 410/46, 410/32, 34, 35, 77, 78, 68; 24/287; 206/503, 206/509; 220/1.5, 4.26, 4.27
See application file for complete search history.

(56) References Cited

U.S. PATENT DOCUMENTS 3,386,600 A * 6/1968 Betjemann ..... 294/68.1
3,459,326 A * 8/1969 Betjemann ..... 220/1.5
3,543,951 A * 12/1970 Marvin ..... 206/503
3,591,033 A * 7/1971 Partridge ..... 220/1.5
3,620,388 A * 11/1971 Mansson ..... 108/53.1
4,068,813 A 1/1978 Chatwin et al.
4,151,925 A * 5/1979 Glassmeyer ..... 220/1.5
4,221,515 A * 9/1980 Brown et al. ..... 410/32
4,537,540 A * 8/1985 Boughton ..... 410/82
4,638,744 A 1/1987 Clive-Smith
4,836,395 A * 6/1989 Goutille ..... 220/1.5
4,986,705 A 1/1991 Durkin
5,183,375 A * 2/1993 Fenton et al. ..... 410/35
5,439,152 A * 8/1995 Campbell ..... 224/405
5,494,182 A 2/1996 Clive-Smith
5,644,992 A 7/1997 Clive-Smith
5,810,186 A * 9/1998 Lam ..... 220/1.5
5,842,821 A 12/1998 Coslovi et al.
6,027,291 A 2/2000 Sain et al.
6,227,397 B1 * 5/2001 Kim ..... 220/8
6,390,742 B1 * 5/2002 Breeden ..... 410/77
6,422,795 B1 * 7/2002 Holt et al. ..... 410/115
6,513,442 B1 * 2/2003 Miller et al. ..... 108/53.1
6,533,510 B1 3/2003 Sain
6,585,126 B1 * 7/2003 Grigsby et al. ..... 220/6
6,655,300 B1 * 12/2003 Clive-Smith et al. ..... 108/53.5
2004/0028496 A1 * 2/2004 Long et al. ..... 410/46
2004/0067118 A1 * 4/2004 Kim ..... 410/46

* cited by examiner

*Primary Examiner*—H. Gutman
(74) *Attorney, Agent, or Firm*—Foley & Lardner LLP

(57) ABSTRACT

A shipping platform includes a platform having adjustable length pillars which are provided on either side and at both ends of the platform. These adjustable length pillars each have an upper cross-member interconnecting the upper ends thereof which can be raised and lowered in accordance with the height of an adjacent container or containers.

22 Claims, 6 Drawing Sheets

SHIPPING PLATFORM

BACKGROUND OF THE INVENTION

1. Field of the Invention

The present invention relates generally to a shipping platform for transport on container ships and the like, and more specifically to an open shipping platform for transporting large vehicles and the like type of cargo and which is adjustable with respect to adjacent containers so as to enable containers to be disposed on top thereof.

2. Description of the Related Art

Open shipping platforms, which have been used to transport vehicles or the like, have had to be left to last and placed on top of the uppermost containers of the containers stacked into the holds and decks of container ships.

SUMMARY OF THE INVENTION

A first aspect of the invention resides in a shipping platform comprising: a platform; and adjustable length pillars provided at either side and at both ends of the platform, the adjustable length pillars each having an upper cross-member interconnecting the upper ends thereof.

This platform is also provided with underside cross-members which are rigidly connected with the platform and which extend parallel with the upper cross-members. The upper and lower cross-members are provided with openings by which the upper and lower cross-members are engageable with side-by-side connection rails or beams used to interconnect containers.

The upper and lower cross-members are provided with apertures which are so sized and located as to allow releasable interconnection with the connection rails they are engageable with. Further, the adjustable length pillars each comprise a base member rigidly connected with the platform and a telescopic member which is slidably disposed with the base member. The upper cross-members interconnect upper ends of a pair of telescopic members.

The adjustable length pillars each further comprise a locking device which selectively locks the telescopic member in one of a plurality of positions relative to the base member. Each locking device comprises a locking pin which is disposed through apertures which are formed in the telescopic member and the base member of the adjustable length pillars.

A second aspect of the invention resides in a shipping platform arrangement comprising: a shipping platform comprising: a platform; and adjustable length pillars provided at either side and at both ends of the platform, the adjustable length pillars each having an upper cross-member interconnecting the upper ends thereof; and first connection rails which are disposed over and connectable to the upper cross-members, the first connection rails being also connectable to at least one container which is disposed adjacent the shipping platform.

In this arrangement, the shipping platform also has lower cross-members fixed to a lower side thereof, the lower cross-members being parallel to the upper cross-members. In addition, first connection devices are used to interconnect the connection rail to the upper cross-member and to an upper side of the at least one adjacent container.

Second connection rails are also disposed under the lower cross-members and interconnected thereto by second connection devices which connect the second connection rails to lower sides of the at least one adjacent container. In accordance with this aspect of the invention the first and second connection devices comprise twist locks.

BRIEF DESCRIPTION OF THE DRAWINGS

The various aspects and advantages of the embodiment of the present invention will become more clearly appreciated as a description thereof is given with reference to the appended drawings in which.

DETAILED DESCRIPTION OF THE EXEMPLARY EMBODIMENTS

Figure 1:
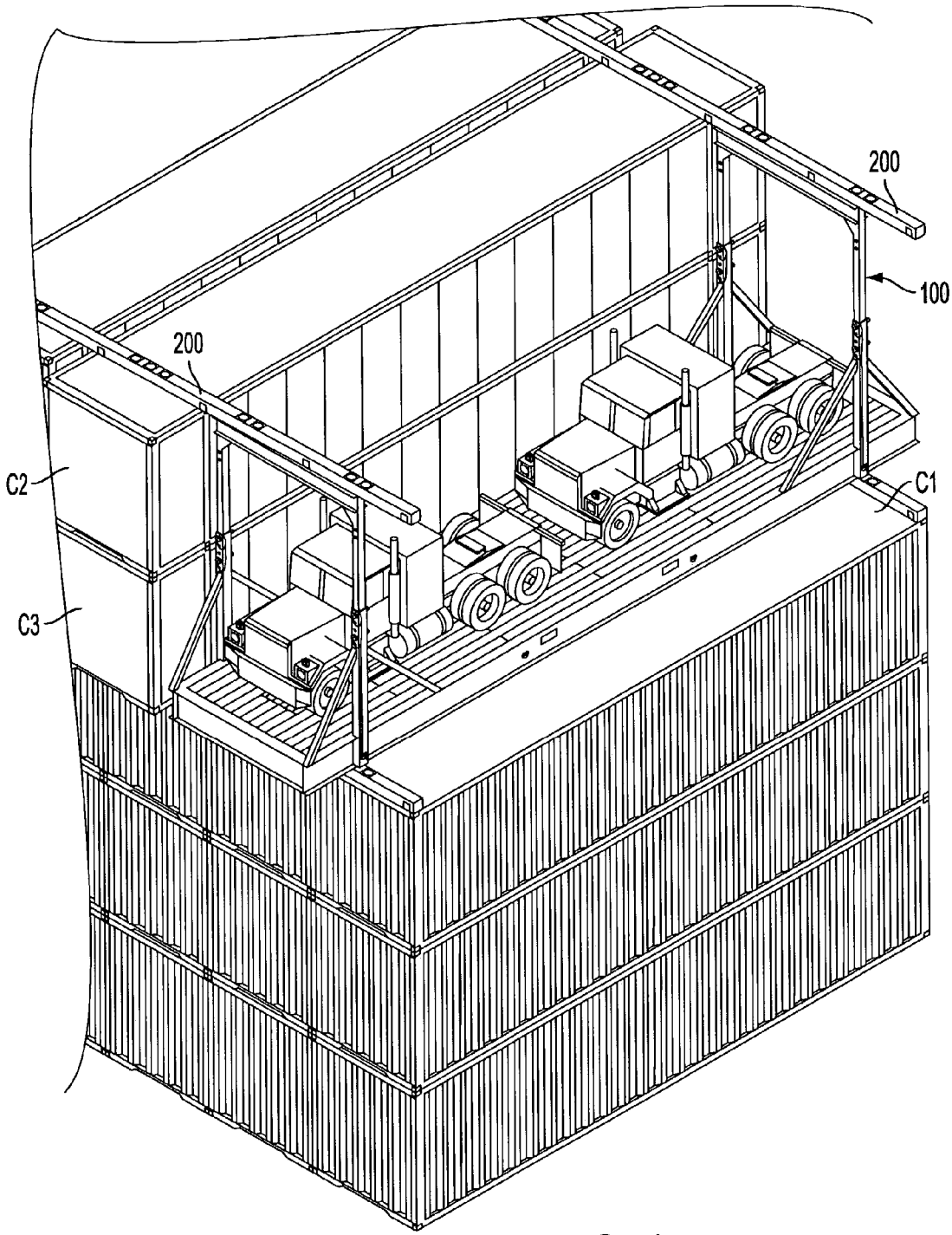
FIG. 1 is a perspective view of an embodiment of the shipping platform according to the present invention, showing its disposition with a plurality of containers in a situation wherein a further container or containers can be disposed on top thereof.
Figure 2:
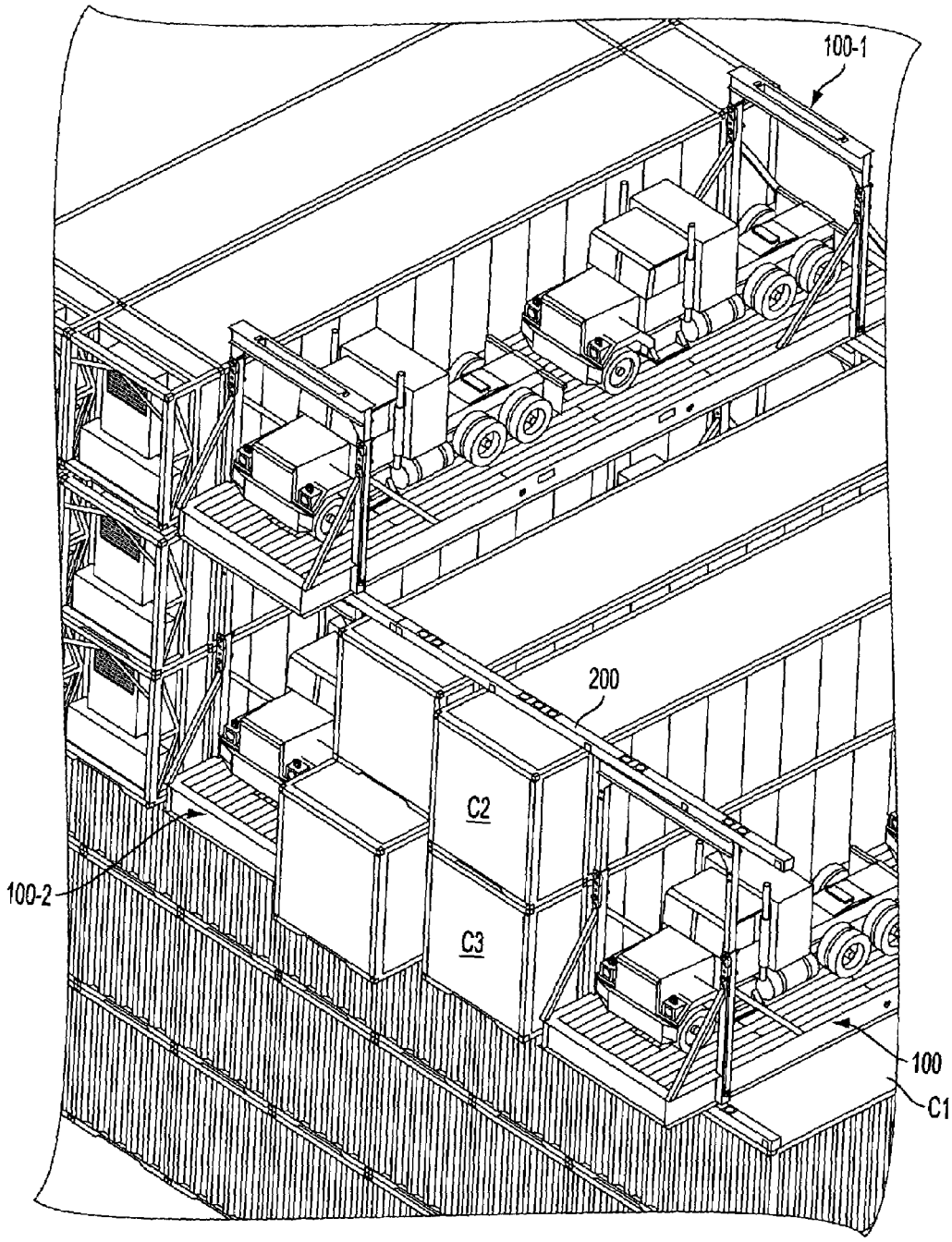
FIG. 2 is a perspective view similar to that shown in FIG. 1 depicting the arrangement wherein two shipping platforms are arranged one on top of the other.
Figure 3:
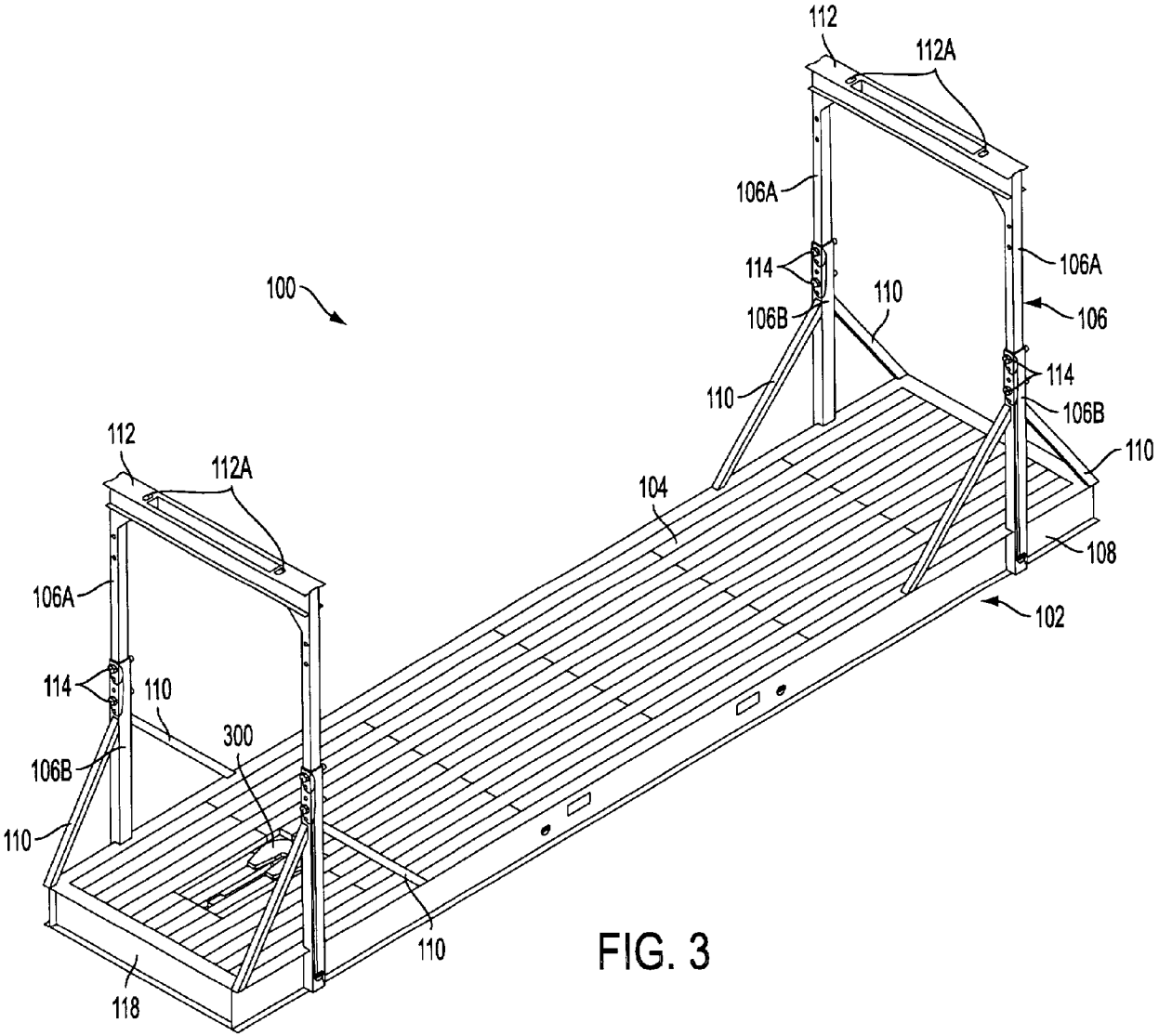
FIG. 3 is perspective view an embodiment of the shipping platform.

FIGS. 1–6 show an embodiment of a shipping platform 100 according the present invention. In this arrangement, as best seen in FIG. 3, a basic platform comprises an I-beam chassis 102 with a planked floor 104 supported thereon. The planking can be either metal or wood. Pairs of pillars or masts 106 are arranged proximate each end of the platform chassis 102. The lower ends of these pillars 106 are secured to the outer sides of side I-beams 108 which form part of the I-beam chassis 102. These pillars 106 are braced in position by angled reinforcing members 110 which, in this embodiment, extend at angles between the pillars and the upper edges of the side I-beams 108 and which are securely welded in position.

Each of the pillars 106 are telescopic so that the height of each of the I-beam upper cross-members 112 which interconnect the upper ends of each end of the telescopic portion 106A with each of the base members 106B of the pillars 106, can be adjusted to and locked in a selected one of a predetermined number of positions. These positions are selected with respect to the heights of the different types of containers beside which the embodiments of the shipping platforms 100 can be disposed.

In the illustrated embodiment, the interlocking of the telescopic members 106A with the base member 106B of the pillars 106 is achieved using locking pins 114 and a series of apertures formed in each of the stationary base and telescopic upper ends 106B, 106A of the pillars. Once the upper ends 106A are in the required relative positional relationship with respect the base members 106B, a locking pin 114 can be inserted through each set of mating apertures to lock the pillars in the desired condition. The locking pins 114 may take the form of bolts so that a nut can be placed on the ends to ensure that vibration and the like does not induce any undesirable movement or disengagement of the pins. Alternatively, the pins 114 may be smooth and can be provided with some other suitable form of securing arrangement such as cross pins or the like to prevent unwanted movement during shipping.

As noted above, the pillars 106 can be set to a plurality of different heights. These heights are selected to correspond to the heights of differently sized containers and further to a fully collapsed position which facilitates storage when not in actual use (see FIG. 6).

A fully extended position or maximum height of the pillars 106 is selected to be higher than the tallest conventional closed type containers. An example of this setting is shown in FIG. 2, wherein shipping platform 100-1 is disposed atop of platform 100-2 and wherein the pillars 106 of the upper shipping platform 100-1 are set at their maximum height.

This maximum height setting can be used to facilitate location and engagement with a lifting apparatus such as a spreader when the platform is placed on the very top of the container stack such as illustrated in FIG. 2.

Figure 4:
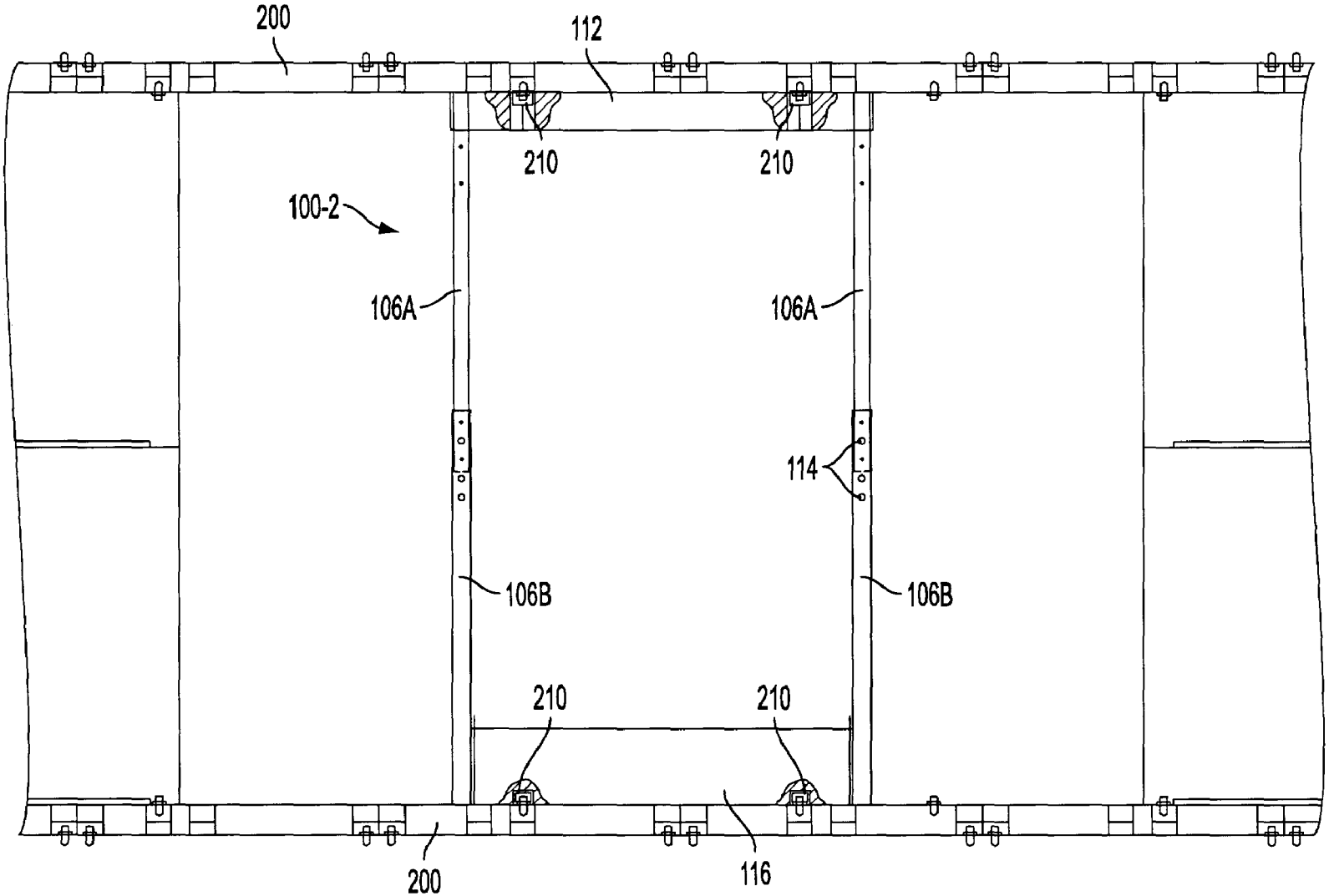
FIG. 4 is an end elevation of the platform showing the manner in which the platform can be connected with connection rails or beams in the manner depicted in FIG. 1.
Figure 5:
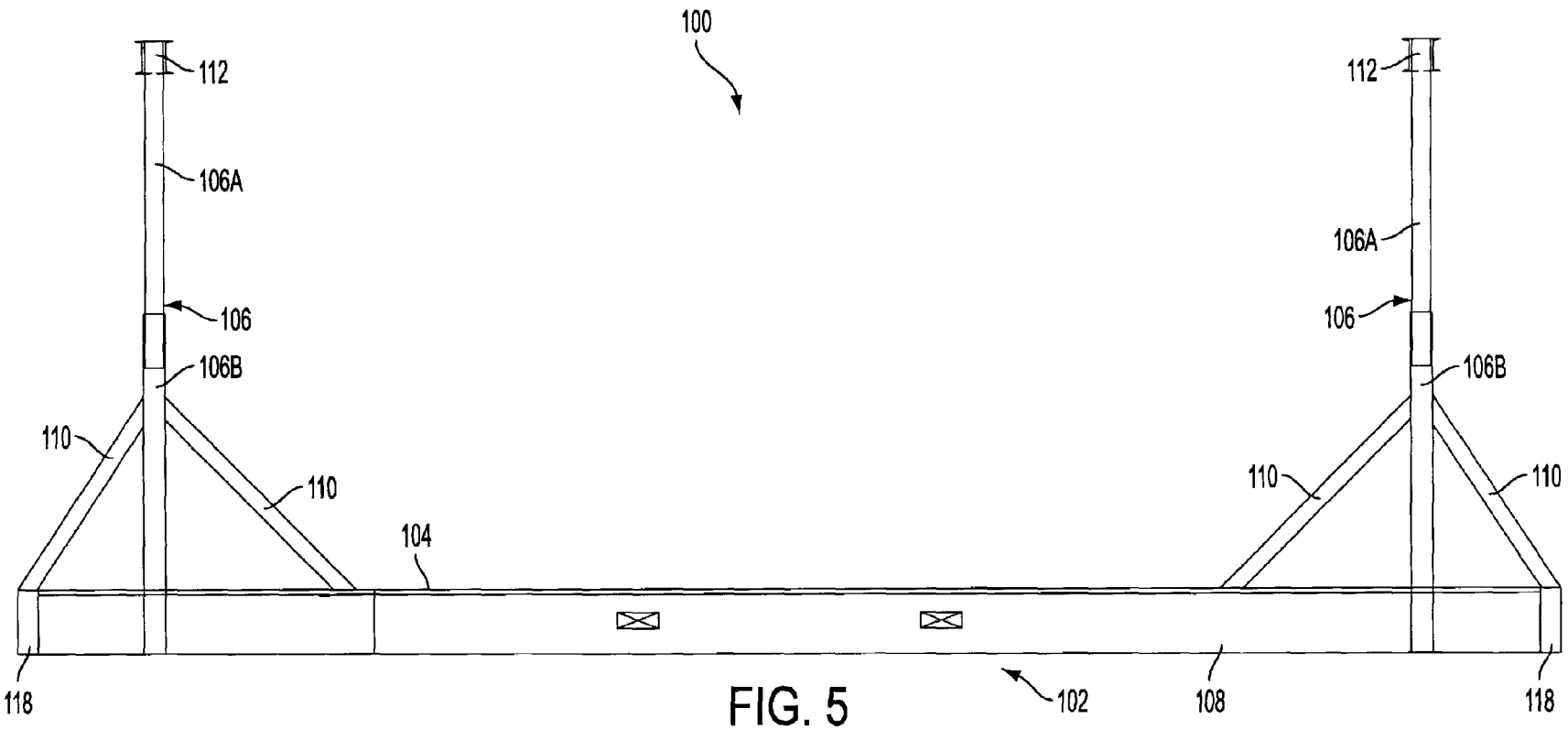
FIG. 5 is a side elevation of the shipping platform embodiment.

The upper cross-members 112 are formed with apertures 112A into which twist locks associated with the connection rails or beams 200, can be disposed and engaged with the cross-members when the connection rails 200 are placed in position in the manner illustrated in FIGS. 2–4.

Figure 6:
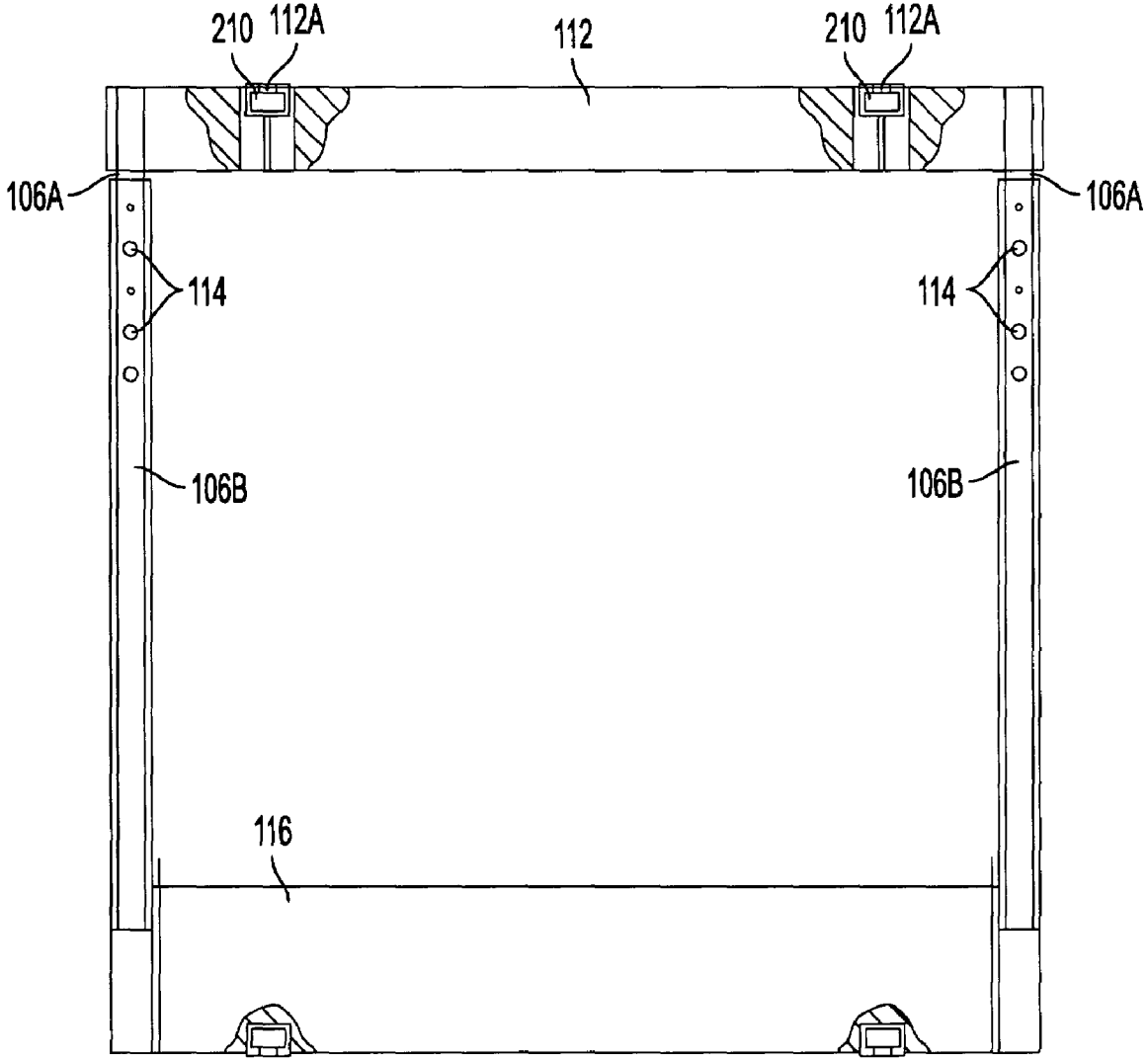
FIG. 6 is an end view showing the support posts of the shipping platform reduced to a minimum height.

Lower cross-members 116 extend across the lower surface of the shipping platform 100 at locations inboard of end I-beams 118 provided at the ends of the platform 100. These lower cross-members 116 are, as best seen in FIGS. 4 and 6, provided with apertures into which twist locks can be disposed. These lower cross-members 118 are, like the remainder of the platform chassis 102, formed of I-beam and are securely welded to the side beams 108 of the platform chassis 102.

An adjustable member 300 for facilitating "tie-down" of vehicles and the like is provided in the floor 104 at one end of the shipping platform. This device can, of course, be omitted or replaced with other members which facilitate the securing of tie-down cables/chains or the like. Alternatively, two or more of these devices can be disposed on the floor 104 as desired.

The above-described shipping platform is adjustable and dispositionable in the manner depicted in FIGS. 1 and 2. As shown in FIG. 1, a shipping platform 100 according to an embodiment of the invention is disposed atop a container C1 and adjacent two other containers C2, C3 by way of two connection rails 200. As shown, the connection rails 200 extend between the shipping platforms 100-1 and 100-2 in manner which allows twist locks 210 to interconnect the two, and then extends over the new two containers (including container C1) and further over the upper cross-member 112 of the shipping platform disposed immediately beside containers C2 and C3.

These connection rails 200 are connectable to containers on either side of the shipping platform 100 in the manner illustrated in FIG. 4. This type of connection permits a fully-loaded, closed-type container to be disposed directly on top of the shipping platform 100 once a connection rail 200 has been disposed over and connected to each of the upper cross-members 112, inasmuch as the load is now shared by the connection rails 200 and the adjacent containers.

As will be appreciated, the embodiments of shipping platforms 100 according to the invention are able to behave spatially, as if they were normal closed containers and thus be disposed anywhere in the container stack via the use of the connection rails. The utility of this arrangement will be immediately appreciated by those involved with container loading and unloading and how this alleviates the need to previously schedule the loading to avoid loss of cargo carrying capacity.

The content of U.S. Pat. No. 6,533,510 is hereby incorporated by reference. This patent which was issued on Mar. 18, 2003 in the name of Sain, and discloses a trailer system and the use of stacking devices which facilitate side-by-side stacking of containers.

For further disclosure relating to structures pertinent to the beams or connection rails 200, reference may be had to U.S. Pat. No. 6,027,291 issued on Feb. 22, 2000 in the name of Sain et al.

Twist lock devices are well known in the art to which this invention is applicable. For further disclosure relating to these devices reference may be had to U.S. Pat. No. 6,460,227 issued in the name of Hove on Oct. 8, 2002, or U.S. Pat. No. 6,390,743 issued to Metternich on May 21, 2002. The content of these patents is hereby incorporated by reference.

While the invention has been disclosed with reference to a limited number of embodiments, the various modifications and variations which can be made without departing from the scope of the invention, which is limited only by the appended claims, will be self-evident to those skilled in the art of container construction and shipping.

What is claimed is:

1. A shipping platform comprising:

an elongate platform; and adjustable length pillars provided on either side and at both ends of the platform, laterally opposed pairs of the adjustable length pillars each having a laterally extending upper cross-member interconnecting upper ends thereof, each laterally extending upper cross-member being provided with openings configured to receive connection devices and spaced to permit connection to at least one of a container, another shipping platform and a connection rail which interconnects containers, and being respectively movable with the upper ends of the laterally opposed pair of adjustable length pillars when the laterally opposed pair of adjustable length pillars are adjusted in length, the shipping platform being configured such that spaces between the laterally extending upper-cross members and the platform are open and free of structure which impedes passage of cargo between the pairs of laterally opposed adjustable length pillars onto the platform.

2. A shipping platform as set forth in claim 1, wherein the platform is provided with underside cross-members which are rigidly connected with the platform and which extend parallel with the upper cross-members.

3. A shipping platform comprising:

an elongate platform; and adjustable length pillars provided on either side and at both ends of the platform, laterally opposed pairs of the adjustable length pillars each having a laterally extending upper cross-member interconnecting upper ends thereof, each laterally extending upper cross-member being respectively movable with the upper ends of the laterally opposed pair of adjustable length pillars when the laterally opposed pair of adjustable length pillars are adjusted in length, the shipping platform being configured such that spaces between the laterally extending upper-cross members and the platform are open and free of structure which impedes passage of cargo between the pairs of laterally opposed adjustable length pillars onto the platform;

wherein the platform is provided with underside cross-members which are rigidly connected with the platform and which extend parallel with the upper cross-members, and wherein the upper and underside cross-members are provided with openings by which the upper and underside cross-members are engageable with connection rails used to interconnect containers.

4. A shipping platform as set forth in claim 3, wherein the connection rails engage the containers in a side-by-side configuration.

5. A shipping platform as set forth in claim 3, wherein the upper and underside cross-members are provided with apertures which are so sized and located as to allow releasable interconnection with the connection rails to which the cross-members are engageable.

6. A shipping platform as set forth in claim 3, wherein the platform is flat and adapted to have vehicles and other oversized cargo secured thereon.

7. A shipping platform as set forth in claim 3, wherein the adjustable length pillars each comprise a base member rigidly connected with the platform and a telescopic member which is slidably disposed with the base member.

8. A shipping platform as set forth in claim 7, wherein the upper cross-members interconnect upper ends of a pair of the telescopic members.

9. A shipping platform as set forth in claim 7, wherein the adjustable length pillars each further comprise a locking device which selectively locks the telescopic member in one of a plurality of positions relative to the base member.

10. A shipping platform as set forth in claim 9, wherein each locking device comprises a locking pin which is disposed through apertures which are formed in the telescopic member and the base member of the adjustable length pillars.

11. A shipping platform as set forth in claim 3, further comprising a connection device which is provided on the platform and adapted to facilitate connection of cargo thereto.

12. A shipping platform as set forth in claim 11, wherein the connection device is movable and selectively positionable on the platform.

13. A shipping platform as set forth in claim 3, wherein the adjustable length pillars are arranged on the platform so that a distance between the adjustable length pillars and the length of the platform are different and such that the adjustable length pillars are located inboard of longitudinally opposed ends of the platform.

14. A shipping platform as set forth in claim 3, wherein the spaces between the laterally extending upper-cross members and the platform are constantly open and free of structure which impedes passage of cargo between the pairs of laterally opposed adjustable length pillars onto the platform.

15. A shipping platform arrangement comprising:

a platform;

adjustable length pillars provided on either side and at both ends of the platform, laterally opposed pairs of the adjustable length pillars each having a laterally extending upper cross-member interconnecting upper ends thereof, each laterally extending upper cross-member being respectively movable with the upper ends of the laterally opposed pair of adjustable length pillars when the laterally opposed pair of adjustable length pillars are adjusted in length, the shipping platform being configured such that spaces between the laterally extending upper cross members and the platform are open and free of structure which impedes passage of cargo between the pairs of laterally opposed adjustable length pillars onto the platform; and first connection rails which are disposed over and connectable to the upper cross-members, the first connection rails being connectable to at least one container which is disposed adjacent the shipping platform.

16. A shipping platform arrangement as set forth in claim 15, wherein the platform further comprises lower cross-members fixed to a lower side thereof, the lower cross-members being parallel to the upper cross-members, and wherein the shipping platform further comprises:

first connection devices which interconnect the first connection rails to the upper cross-members and to an upper side of the at least one container which is disposed adjacent the shipping platform.

17. A shipping platform arrangement as set forth in claim 16, further comprising second connection rails which are disposed under the lower cross-members and interconnected thereto by second connection devices which connect the second connection rails to lower sides of the at least one container which is disposed adjacent the shipping platform.

18. A shipping platform arrangement as set forth in claim 17, wherein the first and second connection devices comprise twist locks.

19. A shipping platform as set forth in claim 15, wherein the adjustable length pillars are arranged on the platform so that a distance between the adjustable length pillars and the length of the platform are different and such that the adjustable length pillars are located inboard of longitudinally opposed ends of the platform.

20. A shipping platform as set forth in claim 15, wherein the spaces between the laterally extending upper-cross members and the platform are constantly open and free of structure which impedes passage of cargo between the pairs of laterally opposed adjustable length pillars onto the platform.

21. A shipping platform comprising:

an elongate platform; and adjustable length pillars provided on either side and at both ends of the platform, laterally opposed pairs of the adjustable length pillars each having a laterally extending upper cross-member interconnecting upper ends thereof, each laterally extending upper cross-member being respectively movable with the upper ends of the laterally opposed pair of adjustable length pillars when the laterally opposed pair of adjustable length pillars are adjusted in length, the shipping platform being configured such that spaces between the laterally extending upper-cross members and the platform are open and free of structure which impedes passage of cargo between the pairs of laterally opposed adjustable length pillars onto the platform, and wherein a portion of the platform extends beyond the adjustable length pillars at at least one end of the platform.

22. A shipping platform arrangement comprising:

a platform;

adjustable length pillars provided on either side and at both ends of the platform, laterally opposed pairs of the adjustable length pillars each having a laterally extending upper cross-member interconnecting upper ends thereof, each laterally extending upper cross-member being respectively movable with the upper ends of the laterally opposed pair of adjustable length pillars when the laterally opposed pair of adjustable length pillars are adjusted in length, the shipping platform being configured such that spaces between the laterally extending upper cross members and the platform are open and free of structure which impedes passage of cargo between the pairs of laterally opposed adjustable length pillars onto the platform; and connection rails which are disposed over and connectable to the upper cross-members, the first connection rails being connectable to at least one container which is disposed adjacent the shipping platform, and wherein a portion of the platform extends beyond the adjustable length pillars at at least one end of the platform.

* * * * *